US007145582B2

(12) United States Patent
Shindo et al.

(10) Patent No.: US 7,145,582 B2
(45) Date of Patent: Dec. 5, 2006

(54) PLASMA DISPLAY PANEL DISPLAY DEVICE AND ITS DRIVING METHOD

(75) Inventors: Katutoshi Shindo, Higasiosaka (JP); Shigeyuki Okumura, Daito (JP); Takatsugu Kurata, Ibaraki (JP); Nobuaki Nagao, Katano (JP); Ryuichi Murai, Toyonaka (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 232 days.

(21) Appl. No.: 10/478,289

(22) PCT Filed: Jan. 22, 2002

(86) PCT No.: PCT/JP02/00418

§ 371 (c)(1),
(2), (4) Date: May 20, 2004

(87) PCT Pub. No.: WO02/099778

PCT Pub. Date: Dec. 12, 2002

(65) Prior Publication Data

US 2004/0196216 A1 Oct. 7, 2004

(30) Foreign Application Priority Data

May 30, 2001 (JP) ..... 2001-162219

(51) Int. Cl.
*G09G 5/10* (2006.01)

(52) U.S. Cl. ..... 345/691; 345/60; 345/66; 345/67; 345/68; 345/41; 345/72

(58) Field of Classification Search ..... 345/691, 345/60–68, 41, 72
See application file for complete search history.

(56) References Cited

U.S. PATENT DOCUMENTS

| | | | | |
|---|---|---|---|---|
| 6,020,687 | A * | 2/2000 | Hirakawa et al. | 385/135 |
| 6,034,482 | A | 3/2000 | Kanazawa et al. | |
| 6,249,087 | B1 * | 6/2001 | Takayama et al. | 315/169.1 |
| 6,424,095 | B1 * | 7/2002 | Hirao et al. | 315/169.4 |
| 6,512,501 | B1 * | 1/2003 | Nagaoka et al. | 345/66 |
| 6,577,061 | B1 * | 6/2003 | Sano et al. | 313/582 |
| 6,914,584 | B1 * | 7/2005 | Homma et al. | 345/63 |

FOREIGN PATENT DOCUMENTS

| | | |
|---|---|---|
| JP | 08-212930 | 8/1996 |
| JP | 10-143108 | 5/1998 |
| JP | 11-109917 | 4/1999 |
| JP | 2000-215813 | 8/2000 |
| JP | 2001-013910 | 1/2001 |
| JP | 2001-13911 | 1/2001 |
| JP | 2001-093424 | 4/2001 |

* cited by examiner

*Primary Examiner*—Amr Awad
*Assistant Examiner*—Sameer Gokhale

(57) ABSTRACT

A method of driving a plasma display device that includes a plurality of scanning electrodes, a plurality of sustaining electrodes, and a plurality of data electrodes is such that, when m is any given integer, the data electrodes are applied with a negative polarity pulse when a voltage applied to the scanning electrodes gradually decreases during the initialization period, if a final pulse in a sustain period of an (m−1)-th subfield is applied to the scanning electrodes and an m-th subfield includes an initialization period. If the final pulse in the sustain period of the (m−1)-th subfield is applied to the sustaining electrodes and the m-th subfield includes the initialization period, the data electrodes are applied with a positive polarity pulse when a voltage applied to the scanning electrodes gradually increases during the initialization period.

17 Claims, 11 Drawing Sheets

PLASMA DISPLAY PANEL DISPLAY DEVICE AND ITS DRIVING METHOD

TECHNICAL FIELD

The present invention relates to a plasma display device and a driving method thereof, and more specifically, a technological improvement to reduce power consumption when driving the plasma display device.

BACKGROUND ART

Plasma display panels (hereinafter referred to as PDPs) display images in such a manner that ultraviolet rays generated by gas discharge excite phosphor material to emit light. The PDPs are classified into two groups based on discharge methods: AC PDPs and DC PDPs. The AC PDPs are superior to the DC PDPs in luminance, luminous efficiency, and duration of life. Above all, reflective surface discharge AC PDPs have become the most popular, because the PDPs of this kind stand out both in the luminance and luminous efficiency.

FIG. 9 is a perspective view illustrating an overview of a PDP unit 10 of a conventional AC PDP. The PDP unit 10 is structured such that discharge cells, each emitting red, green, or blue light, are disposed in lines in an order of colors.

A plurality of pairs of ribbon-shaped transparent electrodes 241 and 251 (made of such as ITO and SnO2) are formed on a front panel glass 21 made of soda lime glass and such. Because sheet resistance of the transparent electrodes 241 and 251 is high, bus electrodes 242 and 252 are formed, in order to reduce the seat resistance, on the transparent electrodes 241 and 251, respectively. The bus electrodes 242 and 252 are formed by such films as silver films, aluminum films, or Cr/Cu/Cr layered thin films. In the above manner, a plurality of pairs of display electrodes 24 and 25 (sustaining electrodes 24 or Y electrodes 24, and scanning electrodes 25 or X electrodes 25) are formed.

A dielectric layer 22 made of transparent low-melting glass and a protecting layer 23 made of magnesium oxide (MgO) are formed, in a stated order, over the front panel glass 21 on which the display electrodes 24 and 25 have been formed. The dielectric layer 22 has a current limiting function which is characteristic to the AC PDP, and this makes the duration of life longer in comparison with the DC PDPs. The protecting layer 23 is provided so as to protect the dielectric layer 22 from being sputtered when discharging. The protecting layer 23 has a high anti-spattering property and a high secondary-emission coefficient (γ), and lowers a discharge start voltage.

A plurality of address electrodes 32 (data electrodes 32; DAT) for writing image data are formed in stripes on a back panel glass 31 so as to become orthogonal to the display electrodes 24 and 25. A base dielectric layer 33 is formed on a surface of the back panel glass 31 so as to cover the data electrodes 32. On a surface of the base dielectric layer 33, a plurality of barrier ribs 34 are formed along the data electrodes 32. Red phosphor layers 35, green phosphor layers 36, and blue phosphor layers 37 are each disposed between two adjacent barrier ribs 34.

Commonly used material for the phosphor layers of each color is as follows.

| | |
|---|---|
| Red phosphor: | $(Y_XGd_{1-X})BO_3:Eu^{3+}$ or $YBO_3:Eu^{3+}$ |
| Green phosphor: | $BaAl_{12}O_{19}:Mn$ or $Zn_2SiO_4:Mn$ |
| Blue phosphor: | $BaMgAl_{10}O_{17}:Eu^{2+}$ |

Spaces surrounded by two adjacent barrier ribs 34 are discharge spaces 38R, 38G, and 38B. A mixture of Neon (Ne) and Xenon (Xe) as a discharge gas is filled in the discharge spaces at a pressure of 66.5 kPa (500 Torr). The barrier ribs 34 also serve as partitions between adjacent discharge cells so as to prevent an improper discharge and an optical cross talk.

Images are displayed in a following manner. An AC voltage of approximately several tens kHz to several hundreds kHz is applied between the pair of the display electrodes 24 and 25, and the discharge is caused in the discharge spaces 38R, 38G, and 38B. Then, Xenon atoms are excited by the discharge and emit ultraviolet rays. The ultraviolet rays excite the phosphor layers 35, 36, 37 to emit visible light, and thus the images are displayed.

Next, a PDP driving unit 40 for driving the PDP unit 10 is explained below.

FIG. 10 is a schematic view illustrating a configuration of the display electrodes 24 and 25, and the data electrodes 32, as well as a connection between the PDP driving unit 40 and the electrodes. M rows of data electrodes 32 and AT columns of pairs of display electrodes (the sustaining electrodes 24 and the scanning electrodes 25) are disposed so as to form an M×N matrix as a total. The discharge cells correspond to areas in the discharge spaces 38R, 38G, and 38B where the data electrodes 32 and the display electrodes face each other.

The PDP driving unit 40 illustrated in FIG. 10 comprises a data driver IC403 connected to each of the data electrodes 32, a sustaining driver IC402 connected to each of the sustaining electrodes 24, a scanning driver IC401 connected to each of the scanning electrodes 25, and a driving circuit 400 that controls the drivers IC401–IC403. The drivers IC401, IC402, and IC403 control electrical flow to the electrodes 25, 24, and 32, respectively. The driving circuit 400 controls overall operation of the drivers IC401, IC402, and IC403, and displays screens in the PDP unit 10 appropriately. The driving circuit 400 includes (a) a storing unit for storing image data that is inputted from outside of the PDP unit 10 for a predetermined period of time, and (b) a circuit for retrieving the stored image data sequentially and performing image processing such as gamma correction.

Note that actual numbers of drivers IC401–IC403 may vary depending on how many electrodes are disposed in the PDP unit.

FIG. 11 is a timing chart of driving waveform when driving the PDP unit 10.

The plasma display device, comprising the PDP unit 10 and the PDP driving circuit 40, displays grayscale with a field including subfields from a first through n-th. Each subfield includes at least a write period and a sustain period when driving. The timing chart in FIG. 11 illustrates the driving waveform in a (m−1)-th subfield and a m-th subfield. Both m and n are any given integers. An example in FIG. 11 includes subfields having at least either of an initialization period or an erase period. Numbers of pulses applied to the scanning electrodes 25 and the sustaining electrodes 24 during the sustain period may vary according to the grayscale.

An operation in the m-th subfield is as follows, for example.

First, in the initialization period, an initializing pulse is applied to the scanning electrodes (SCN) as shown in FIG. 11. In this period, the sustaining electrodes (SUS) and the data electrodes (DAT) are grounded. By applying a voltage having the driving waveform whose amplitude increases gradually, a gradually increasing voltage is applied to the scanning electrodes 25. After that, while a voltage is applied to the sustaining electrodes 24, a gradually decreasing voltage is applied to the scanning electrodes 25. Thus wall charge in the cells is initialized.

Then, in the write period, in order to display a first row in the M×N matrix, a first write pulse (Vb) is applied to a first row of the scanning electrodes 25 and a second write pulse (Vdat) is applied to a data electrode 32 corresponding to a discharge cell. By the above voltage application, a writing discharge (an address discharge) is generated between the scanning electrode in the first row and the corresponding data electrode 32, the wall charge is formed on a surface of the dielectric layer 22, and writing to the first row is carried out.

When the above operation is completed to a N-th row, the writing process is done, and a latent image is written for one screen.

Next, in the sustain period, with all of the data electrodes grounded, a sustaining pulse voltage (Vs) is applied to all of the sustaining electrodes 24, then to all the scanning electrodes 25. After that, the sustaining pulse voltage (Vs) is applied alternately to the sustaining electrodes 24 and the scanning electrodes 25. Accordingly, light emission caused by a sustain discharge is maintained in the cells at which writing has been carried out during the write period, and an actual screen is displayed.

After this, in the erase period, the wall charge is removed by applying the gradually decreasing voltage to the scanning electrodes 25.

The images are displayed in the PDP unit 10 in the above manner.

However, the conventional driving method explained in the above has the following problem.

In general, voltage resistance of a data driver IC used for the PDP driving unit 40 is relatively low, and accordingly, the write pulse applied during the write period is not secured sufficiently in some cases. In a case of the plasma display device whose discharge start voltage (Vf) is relatively high, there is a possibility that the voltage applied by the write pulse does not reach the discharge start voltage and the data writing becomes unstable. This could result in degradation of image quality such as flickering and failure in lighting.

Especially, plasma display devices having a high-resolution cell structure, such as hi-vision plasma display devices, are susceptible to the above noted problem. Specifically, when driving the plasma display devices of this kind, it is required to make time length of subfields shorter than usual in order to complete the discharge within a short write pulse period, and it is said that a driving voltage to the data electrodes needs to be set higher in comparison with a case of VGA standard plasma display devices. Thus, the low voltage resistance of the data driver IC could also be a major problem.

Moreover, each of the red, green, and blue phosphor layers used for a PDP unit has a different chemical property. Accordingly, the write pulse of each of the discharge cells varies according to the colors of the phosphor layers even when the same amount of power is supplied, and a discharge ratio (lighting efficiency) of each of the discharge cells also varies according to the colors. While it is possible to set the driving voltage to the data electrodes 32 as high as possible in order to avoid effects of the variation in the write pulse, i.e. the driving voltage is set at the write pulse of the cell that has a best lighting efficiency, the low voltage resistance of the data driver IC is still a problem.

One solution to the above problem is to use ICs having a high-voltage resistance for the data driver IC. However, using the ICs of this kind should be avoided, because the ICs having the high voltage resistance are generally expensive and will increase costs for the plasma display devices. Moreover, even if such high output diver ICs are employed, it can lead to a new problem that power consumption of the plasma display device increases. Therefore, this solution is not desirable, considering the recent trend that display size has become increasingly larger.

DISCLOSURE OF THE INVENTION

The present invention is made in view of the above problem. An object of the present invention is to provide plasma display devices that are cost effective and enable excellent image display even when using a PDP unit having a high-resolution cell structure, such as hi-vision plasma display panels, and driving methods of such plasma display devices.

In order to solve the above problem, the present invention is a method of driving method of driving a plasma display device in which a plurality of scanning electrodes and a plurality of sustaining electrodes are formed on a first substrate of a plasma display panel, and a plurality of data electrodes are formed on a second substrate of the plasma display panel, the first substrate and the second substrate being positioned so as to face each other, wherein if a final pulse in a sustain period of an (m−1)-th subfield is applied to the scanning electrodes and an m-th subfield includes an initialization period, the data electrodes are applied with a negative polarity pulse at the same time when a voltage applied to the scanning electrodes gradually decreases during the initialization period, if the final pulse in the sustain period of the (m−1)-th subfield is applied to the sustaining electrodes and the m-th subfield includes the initialization period, the data electrodes are applied with a positive polarity pulse at the same time when a voltage applied to the scanning electrodes gradually increases during the initialization period, and m is any given integer.

The present invention may also be a method of driving a plasma display device in which a plurality of scanning electrodes and a plurality of sustaining electrodes are formed on a first substrate of a plasma display panel, and a plurality of data electrodes are formed on a second substrate of the plasma display panel, the first substrate and the second substrate being positioned so as to face each other, wherein if a final pulse in a sustain period of a m-th subfield is applied to the scanning electrodes and the sustain period is followed by an erase period, the data electrodes are applied with a negative polarity pulse at the same time when a voltage applied to the scanning electrodes gradually decreases during the initialization period, if the final pulse in the sustain period of the m-th subfield is applied to the sustaining electrodes and the sustain period is followed by the erase period, the data electrodes are applied with a positive polarity pulse at the same time when a voltage applied to the sustaining electrodes gradually decreases during the initialization period, and m is any given integer.

By the above method, a potential of the scanning electrodes to the data electrodes is kept high at the end of both the initialization period and the erase period in a subfield, and the wall charge can be maintained, while, with the conventional method, the potential of the scanning electrodes to the data electrodes becomes low at the end of both the initialization period and the erase period in a subfield, and the wall charge is removed. Accordingly, it is possible to utilize the wall charge, which disappears in the case of the conventional method, in a successive write period and sustain period. The present invention enables to secure a sufficient amount of wall charge without a high power supply in comparison with the conventional method, and accordingly, it is possible to apply appropriate discharge start voltages to discharge cells that correspond to phosphor layers of each color. Therefore, without using the expensive high pressure resistant data driver ICs, the present invention demonstrates an excellent display performance by performing the write discharge (i.e. driving with a low voltage) without causing a cost increase or a heat generation in the circuit.

The present invention may also be such that the above methods of driving the plasma display devices, wherein the a plurality of barrier ribs are disposed on the second substrate in a direction along the data electrodes, each pair of adjacent barrier ribs having a phosphor layer disposed therebetween along one of the data electrodes, each phosphor layer being one of red, green, and blue, and a peak value of one of the negative polarity pulse and the positive polarity pulse is applied to the data electrodes each corresponding to the phosphor layer of a color having a lowest lighting efficiency.

In general, the color having the lowest lighting efficiency is blue.

Further, it is also possible that a peak value of one of the negative polarity pulse and the positive polarity pulse is determined according to a discharge ratio of any given data electrode.

Specifically, when the discharge ratio is in a range of 63% inclusive to 95% exclusive, the peak value of the negative polarity pulse is set in a range of −50 V inclusive to 0 V exclusive, when the discharge ratio is in a range of 40% inclusive to 63% exclusive, the peak value of the negative polarity pulse is set in a range of −60 V inclusive to −5 V inclusive, and when the discharge ratio is lower than 40%, the peak value of the negative polarity pulse is set in a range of −80 V inclusive to −10 V inclusive.

The above described effect of the present invention can be achieved by a plasma display device comprising (a) a plasma display panel in which a plurality of pairs of display electrodes are formed on a first substrate, and a plurality of data electrodes and a plurality of barrier ribs are formed on a second substrate, the first substrate and the second substrate being positioned so as to face each other in a manner that the display electrodes and the data electrodes cross, and each pair of adjacent barrier ribs having a phosphor layer disposed therebetween along one of the data electrodes, each phosphor layer being one of red, green, and blue; and (b) a plasma display panel driving unit that applies voltages to the data electrodes and the pairs of display electrodes based on settings for a driving waveform process, wherein a pulse voltage that is applied to any given data electrode or to any given data electrode group is independent from a pulse voltage that is applied to data electrodes other than the given data electrode or the given data electrode group.

BEST MODE FOR CARRYING OUT THE INVENTION

[First Embodiment]

1-1 Construction of Plasma Display Device (PDP Driving Unit)

A plasma display device according to a First Embodiment comprises a PDP unit 10 and a PDP driving unit 40. The PDP unit 10 has substantially the same construction as a conventional PDP, and the PDP driving unit 40 is a characteristic part to the plasma display device of the present embodiment. Thus, in the following explanation, the PDP driving unit 40 is detailed.

Figure 1:
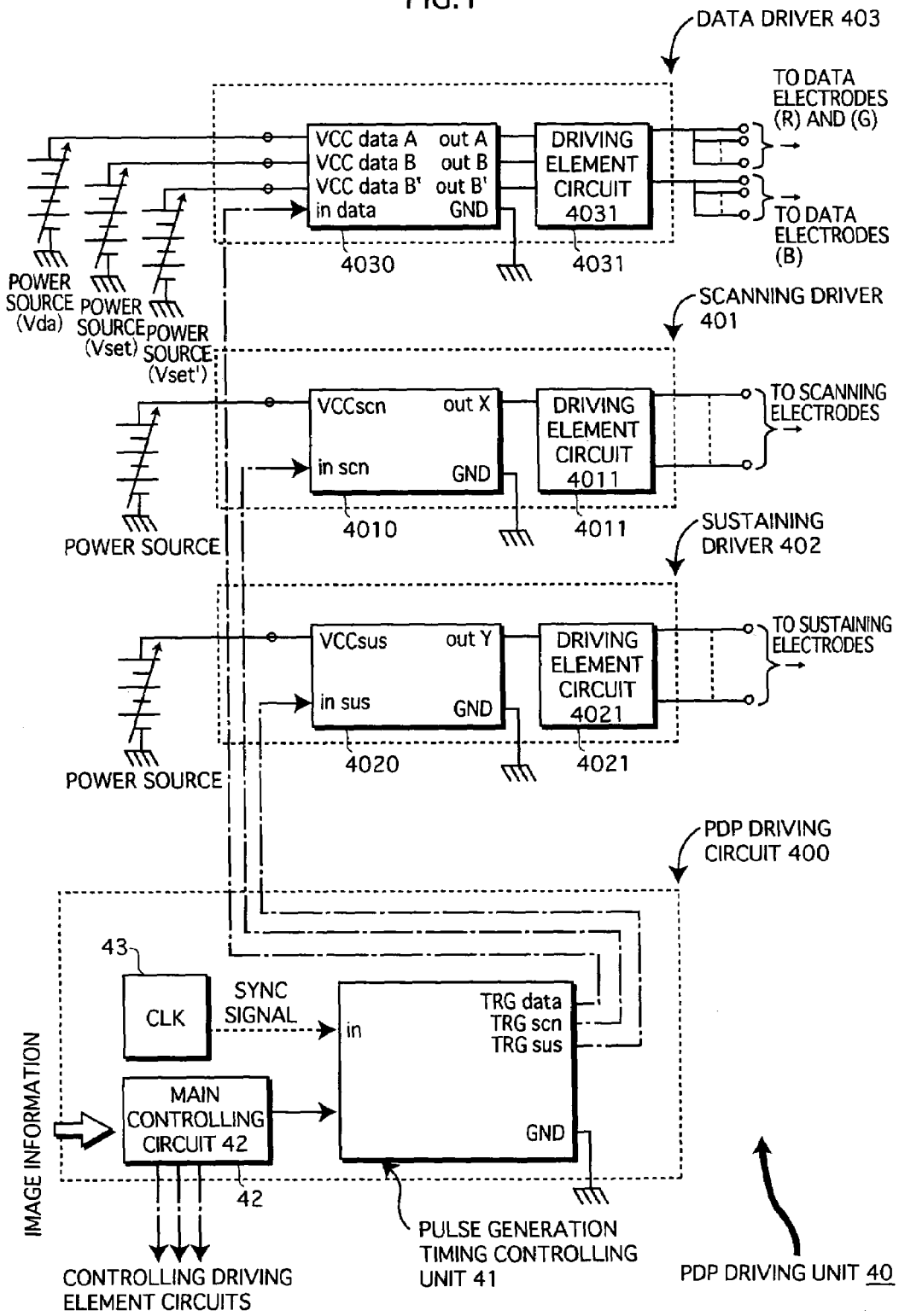
FIG. 1 is a block diagram of a PDP driving unit according to a First Embodiment of the present invention.

FIG. 1 is a block diagram of the PDP driving unit 40 according to the First Embodiment.

The PDP driving unit 40 as illustrated in this drawing comprises a data driver 403 connected to each of data electrodes 32, a scanning driver 401 connected to each of scanning electrodes (X electrodes) 25, a sustaining driver 402 connected to each of sustaining electrodes (Y electrodes) 24, and a PDP driving circuit 400 that controls operations of the drivers 401–403.

The PDP driving circuit 400 includes a sustain pulse generation timing controlling unit (hereinafter referred to as pulse controlling unit) 41, a main controlling circuit 42, and a clock circuit 43.

The clock circuit 43 includes a clock (CLK) generating unit and a Phase Locked Loop (PLL) circuit, and generates a sampling clock (a sync signal) and outputs the sampling clock to the main controlling circuit 42 and the pulse controlling unit 41.

The main controlling circuit 42 includes (a) a storing unit (a frame memory) for storing image data inputted from outside of the PDP unit 10 for a predetermined period of time, and (b) a plurality of image processing circuits (not shown in the drawing) for retrieving the stored image data sequentially and performing image processing such as gamma correction. A sync signal generated in the clock circuit 43 is transmitted to the main controlling circuit 42, and the main controlling circuit 42 retrieves image information based on the sync signal and performs the image processing. The image data after the processing is transmitted to driving element circuits 4011, 4021, and 4031, each contained in the drivers 401, 402, and 403, respectively. The main controlling circuit 42 also controls the driving element circuits 4011, 4021, and 4031.

The pulse controlling unit 41 includes a known sequence controller and a known microcomputer (not shown in the drawing). According to a controlling program in the microcomputer and based on the sync signal from the clock circuit 43, the pulse controlling unit 41 transmits three kinds of pulses according to the driving waveform sequences (TRG scn, TRG sus, and TRG data) to the scanning driver 401, the sustaining driver 402, and the data driver 403 on a predetermined timing that is separately set to each of the drivers. The waveform and the output timing of the pulses are controlled by the microcomputer. The driving pulse sequences are formed in the microcomputer of the pulse controlling unit 41 by processing the image data after the image processing.

The scanning diver 401, the sustaining driver 402, and the data driver 403, comprising common driver ICs (NECμPD16306A/B for the data driver, and TI SN755854 for the scanning driver, for example), include pulse output units 4010, 4020, and 4030, and the driving element circuits 4011, 4021, and 4031, respectively.

Each of the pulse output units 4010, 4020, and 403 is individually connected to an external high voltage direct-current power source for power supply. The pulse output units 4010, 4020, and 403 output predetermined voltages (VCC scn, VCC sus, and VCC data A/B/B', respectively), which are obtained by the high voltage direct-current power sources, to the driving element circuits 4011, 4021, and 4031 (out X, out Y, and out A/B/B', respectively), respectively, based on the pulses (in scn, in sus, and in data, respectively) transmitted from the pulse controlling unit 41.

As a major characteristic of the First Embodiment, in the data driver 403, a power source used for the write pulse (Vda power source) and two high voltage direct-current power sources (Vset and Vset' power sources) are connected to the pulse output unit 4030. Voltages originated from the above three power sources (VCC data A/B/B') are each connected to two data electrode 32 groups via the driving element circuit 4031 so as to conduct electricity. A control program in the main controlling circuit 42 controls the conduction to each of the data electrodes 32. As shown in the drawing, according to the First Embodiment, one of the two data electrode 32 groups corresponds to the red phosphor layer 36 and green phosphor layer 37, and the other corresponds to the blue phosphor layer 38.

In the above described construction of the PDP driving unit 40, when driving the plasma display device, the control program of the main controlling circuit 42 applies a negative polarity pulse to the data electrodes 32 while the gradually decreasing voltage is applied to the scanning electrodes 25 during at least one of the initialization period and the erase period in the subfields. An absolute value of the negative polarity pulse for the blue phosphor layer 38 is set to be larger than an absolute value for the red phosphor layer 36 and green phosphor layer 37.

The major reason of having the above described construction is to obtain an effect explained below.

1-2 Effect of First Embodiment 1

Generally speaking, when driving the plasma display device, the subfield includes at least one of the initialization period and the erase period either before or after the write period and sustain period. During the initialization period and the erase period, an operation, which reduces an amount of the wall charge (priming particle weight) in the discharge spaces 38R, 38G, and 38B to an sufficient amount and makes the wall charge uniform in advance, is performed in order to prepare for the write period and the sustain period.

Note that the "initializing" refers to an operation for making the wall charge of all of the cells of a PDP unit uniform, and the "clearing" here refers to an operation for making the wall charge of given cells (cells that have lighted) uniform.

After reducing the wall charge and making the wall charge uniform in the discharge spaces 38R, 38G, and 38B by performing initializing and clearing, the wall charge is formed in the discharge spaces 38R, 38G, and 38B again by applying the write pulse to the data electrodes 32 and the scanning pulse to the scanning electrodes 25 in the write period. Then, the write discharge is performed.

The conventional method has a problem here.

Specifically, in a case of a plasma display device having a relatively high discharge start voltage (vf) during the sustain period, sufficient amount of the write pulse sometimes often cannot be obtained (because the write discharge is not sufficient or is not generated at all) When the write pulse is not sufficient, some of the discharge cells cannot light and the display performance causes marked deterioration. Plasma display devices of high resolution standard (so called hi-vision plasma display devices) are susceptible to such a problem, because a plasma display device of this kind has more scan lines in a display and a shorter write pulse width of the write pulse to the data electrodes 32, and accordingly, the write pulse with relatively a high voltage becomes necessary.

In addition, the discharge start voltage in each of the cells varies according to charging characteristics and film thickness of the red phosphor layer 35, green phosphor layer 36, and blue phosphor layer 37, each disposed in the each of the cells, and size of the discharge space. When the discharge start voltage of the blue phosphor layer 37 is the highest, a voltage in the writing pulse also needs to be high.

One solution to such a problem is to use a data driver IC having a relatively high voltage resistance and make it possible to apply a higher voltage in the write pulse in comparison with the conventional data driver. By this, the lighting efficiency of all of the cells increases. Specifically, when the discharge start voltage in the cells having the blue phosphor layer 37 is the highest, the same voltage is applied to all of the electrodes 32 in accordance.

However, high pressure resistant driver ICs are expensive, and using the high pressure resistant driver ICs will increase the production cost. Moreover, even if the high pressure resistant drivers are used, the write pulse becomes high as a result and could result in new problems such as an increase in the power consumption of the plasma display device and a rise in an calorific value of the PDP driving unit 40. Therefore, using the high pressure resistant driver ICs is not desirable.

In the First Embodiment, the data electrodes 32 each corresponding to one of the red phosphor layer 35, green phosphor layer 36, and blue phosphor layer 37 are classified into two groups: one of the two data electrode 32 groups corresponds to the red phosphor layer 35 and green phosphor layer 36, and the other corresponds to the blue phosphor layer 37. Each of the two groups of electrodes 32 is supplied by a separate power source. By such a connection structure, when driving the plasma display device, a negative polarity pulse is applied to the data electrodes 32 while the gradually decreasing voltage is applied to the scanning electrodes 25 during the initialization period and the erase period in the subfields.

By such a construction, it is possible to retain the wall charge, which is lost in the case of the conventional plasma display devices, during the initialization period and the erase period. Accordingly, the retained wall charge can be utilized in the successive write period and for the sustain discharge, and it is possible to apply an appropriate discharge start voltage (vf) to the cells each corresponding to the red phosphor layer 35, green phosphor layer 36, and blue phosphor layer 37 without supplying a high voltage as in the conventional case.

Therefore, the present embodiment enables a preferable image display without causing a cost increase or a heat generation in the circuit, in comparison with the above described solution to achieve the high discharge start voltage by using the expensive high pressure resistant data driver ICs.

1-3 Process for Driving Plasma Display Device

Figure 2:
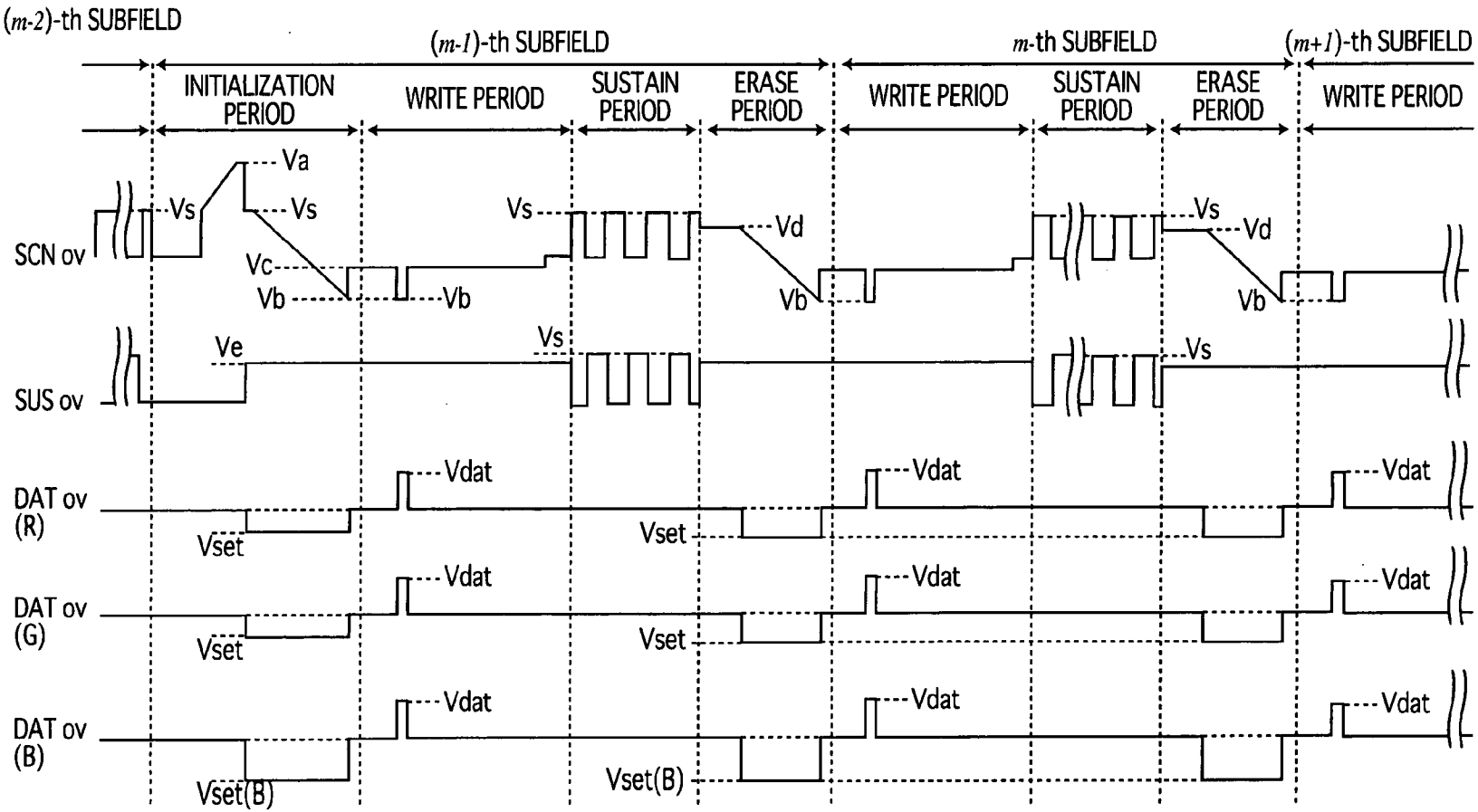
FIG. 2 is a timing chart of a driving wave form according to the First Embodiment.

An example of driving process according to the plasma display device having the above construction is explained below in accordance with a timing chart of a driving waveform in a (m−1)-th subfield as illustrated in FIG. 2.

Note that a final pulse in the sustain period of a (m−2)-th subfield is applied to the scanning electrodes 25.

Further, in a case in which the PDP unit 10 is a VGA standard panel (853×480 pixels), specific values in the driving waveform can be as follows.

Va=400 v (a maximum value in the initialization period of the scanning electrodes 25)

Vb=−100 v (a minimum value in the initialization period of the scanning electrodes 25, and the write pulse to the scanning electrodes 25)

Vc=−20 v (a base value of the scanning electrodes 25 in the write period)

Vd=140 v (a base value of the scanning electrodes 25 in the erase period)

Ve=150 v (a voltage value applied to the sustaining electrodes 24 in the initialization period and the write period)

Vs=180 v (a voltage applied to the scanning electrodes 25 and the sustaining electrodes 24 in the sustain period)

Vdat=67 v (the write pulse value to the data electrodes 32)

Vset=−20 v (a voltage value applied to the data electrodes 32, which correspond to the red and green phosphor layers, in the initialization period)

Vset(B)=−50 v (a voltage value applied to the data electrodes 32, which correspond to the blue phosphor layer, in the initialization period)

In a case of the above example of the VGS standard panel, a pitch between the barrier ribs 34 is 360 μm, a thickness of the dielectric layer 22 is 42 μm, a thickness of the protecting film 23 is 0.8 μm, a gap between a pair of display electrodes 24 and 25 is 80 μm, and a height of the barrier ribs 34 is 120 μm.

Further, in a case in which the PDP unit 10 is a XGA standard panel (1024×768 pixels), specific values can be as follows.

Va=400 v (a maximum value in the initialization period of the scanning electrodes 25)

Vb=−90 v (a minimum value in the initialization period of the scanning electrodes 25, and the write pulse to the scanning electrodes 25)

Vc=−10 v (a base value of the scanning electrodes 25 in the write period)

Vd=140 v (a base value of the scanning electrodes 25 in the erase period)

Ve=150 v (a voltage value applied to the sustaining electrodes 24 in the initialization period and the write period)

Vs=160 v (a voltage applied to the scanning electrodes 25 and the sustaining electrodes 24 in the sustain period)

Vdat=67 v (the write pulse value to the data electrodes 32)

Vset=−20 v (a voltage value applied to the data electrodes 32, which correspond to the red and green phosphor layers, in the initialization period)

Vset(B)=−50 v (a voltage value applied to the data electrodes 32, which correspond to the blue phosphor layer, in the initialization period)

In a case of the above example of the XGA standard panel, a pitch between the barrier ribs 34 is 300 μm, a thickness of the dielectric layer 22 is 35 μm, a thickness of the protecting layer 23 is 0.8 μm, a gap between a pair of display electrodes 24 and 25 is 80 μm, and a height of the barrier ribs 34 is 120 μm.

1-3-1 Initialization Period

During the initialization period, the scanning driver 401 of the PDP driving unit 40 applies a positive polarity initializing pulse to each scanning electrode 25 (X electrode 25) to initialize charges (wall charge) in each of the cells.

A waveform of the initializing pulse applied to the scanning electrodes 25 is shown in FIG. 2; it increases gradually at first, and then decreases gradually. At the same time when the voltage applied to the scanning electrodes 25 reaches the maximum value (Va), a rectangular positive polarity pulse (Ve) is applied to the sustaining electrodes 24.

Here, as a main characteristic of the First Embodiment, a negative polarity voltage (Vset) is applied to the data electrodes 32 while the gradually decreasing voltage is applied to the scanning electrodes 25. Further, when the final pulse in the sustain period is applied to the scanning electrodes 25 in a subfield, the negative polarity pulse (Vset) is also applied to the data electrodes 32 while the gradually decreasing voltage is applied in the erase period which is successive to the sustain period. When both the initialization period and the erase period are included in one subfield, it is desirable to apply the negative polarity pulse in the both period, although the negative polarity pulse may be applied only during one of the both period.

A reason why the negative polarity pulse is applied to the data electrodes 32 is explained below.

Figure 3:
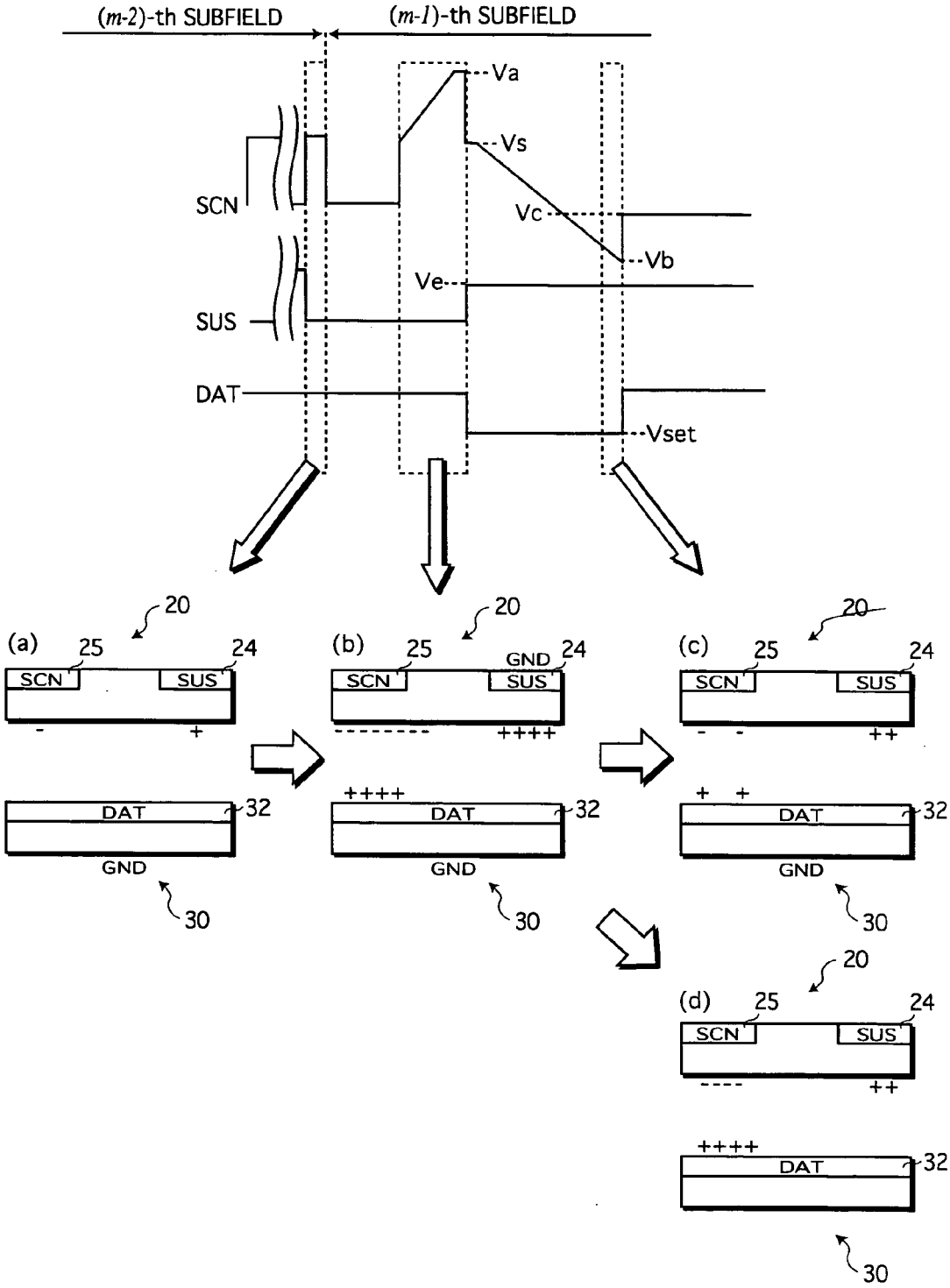
FIG. 3 is a state diagram illustrating a state of electrical charge of a PDP unit in subfields in the First Embodiment.

FIG. 3 is a timing chart of driving waveform during the sustain period in a (m−2)-th subfield and the initialization period in the (m−1)-th subfield that is successive to the (m−2)-th subfield in FIG. 2. Also in FIG. 3, "(a)→(b)→(c)" indicates a shift in a state of electrical charge of the conventional PDP, and "(a)→(b)→(d)" indicates a shift in a state of electrical charge of the PDP unit 10 according to the First Embodiment.

Conventionally, when the sustain period in the (m−2)-th subfield ends with a pulse applied to the scanning electrodes 25, a small amount of charge is left at the scanning electrodes 25 and the sustaining electrodes 24 as shown in FIG. 3(*a*). Then, when the scanning electrodes 25 are applied with a gradually increasing voltage (up ramp) during the initialization period in the (m−1)-th subfield, a negative charge is formed on the scanning electrodes 25 as shown in FIG. 3(*b*), and a positive charge is formed on both the sustaining electrodes 24 and data electrodes 32 by a dielectric effect caused at the same time. The wall charges formed in the above, however, substantially disappear after the scanning electrodes 25 are applied with a gradually decreasing voltage (down ramp), as shown in FIG. 3(*c*). Accordingly, the power supply for the scan pulse (Vb) applied to the scanning electrodes 25 and the write pulse (Vdat) applied to the data electrodes 32 during the write period successive to the initialization period is largely dependent upon an external power source.

Figure 4:
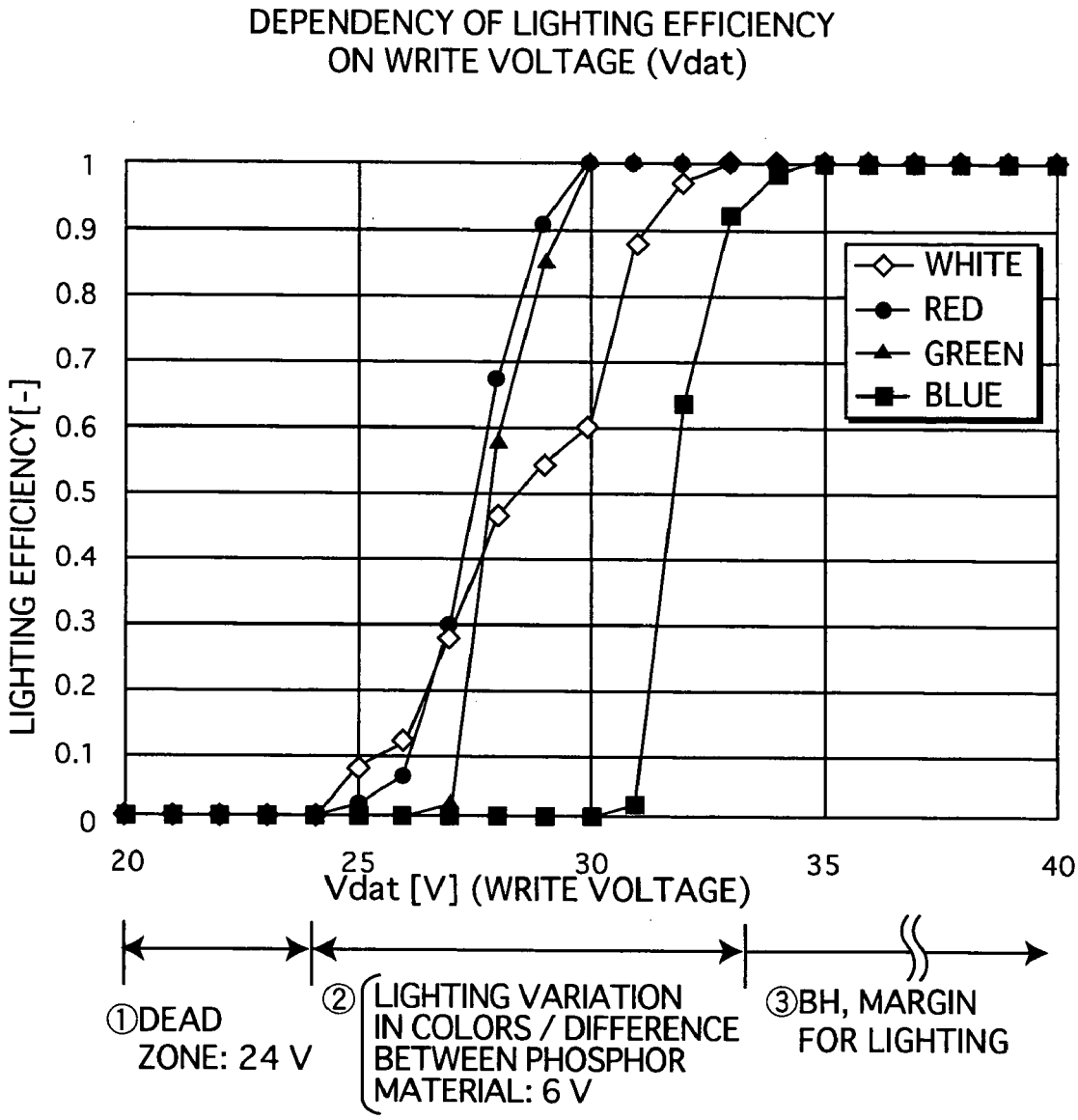
FIG. 4 is a graph illustrating a relation between lighting efficiency and a write pulse for each of red, green, and blue phosphors.

On the other hand, it is often observed that the discharging is not easily caused in a case of the data electrodes 32 corresponding to some of the red, green, and blue phosphor layers 35, 36, and 37, such as the blue phosphor layer 37, for example. FIG. 4 is a graph illustrating a relation between lighting efficiency and the write pulse for the cells each corresponds one of red, green, and blue phosphor layers 35, 36, and 37. According to the drawing, none of cells lights when the write voltage is lower than 24 V. When the write voltage is 24 V or larger up to around 33 V, lighting of the cells of each color varies. When the write voltage is higher than 33V, finally all of the cells including RGB and white light. As shown in the data in the drawing, the data electrodes 32 that correspond to the blue phosphor layer 37 require the write pulse of a highest voltage among the red, green, and blue phosphor layers 35, 36, and 37. It is considered to be an influence of a property of the blue phosphor material.

In view of the above problem, in the First Embodiment, the negative polarity pulse is applied to the data electrodes 32 while the gradually decreasing voltage is applied to the scanning electrodes 25 during the initialization period. The wall charge formed in the conventional PDP as shown in FIG. 3(*b*) (an application of the gradually increasing voltage to the scanning electrodes 25) substantially disappears, because a potential of the scanning electrodes 25 to the data electrodes 32 becomes considerably low, when the initialization period ends, if the negative pulse is not applied to the data electrodes 32. However, according to the First Embodiment, the potential of the scan electrodes 25 to the data electrodes 32 is maintained relatively high until the end of the initialization period, and accordingly the wall charge is also maintained. Therefore, a sufficient amount of the wall charge is kept even at a point (d) in FIG. 3, where the end of the initialization period is very close. Thus, in the First Embodiment, an actual power supply from the external power source (refer to the high voltage direct-current power source in FIG. 1) is reduced when applying the write pulse to the data electrodes 32 in the write period successive to the initialization period. In other words, an amount of necessary power supply to the data electrodes 32 in order to perform a write discharge is not very large. Accordingly, it is possible to perform the write discharge with a sufficient amount of charge without using a high pressure resistant data driver IC, and demonstrate an excellent display performance at a low cost, even if the PDP unit 10 is a hi-vision display with a fine cell structure that has a small pulse width of the write pulse to the data electrodes 32 at the write discharge.

In addition, in the First Embodiment, it is also possible, while the gradually decreasing voltage is applied during the initialization period, to apply to the data electrodes 32 corresponding to the blue phosphor layer 37 with a negative polarity pulse (Vset (B)) whose absolute value is larger than an absolute value of a negative polarity pulse applied to the data electrodes the red and green phosphor layers 35 and 36. By doing so, it is possible that the data electrodes 32 corresponding to the blue phosphor layer 37 hold even more wall charge, and that the write discharge is performed in the discharge cells corresponding to the phosphor layer 37 of blue with a relatively small amount of external power supply.

Figure 5:
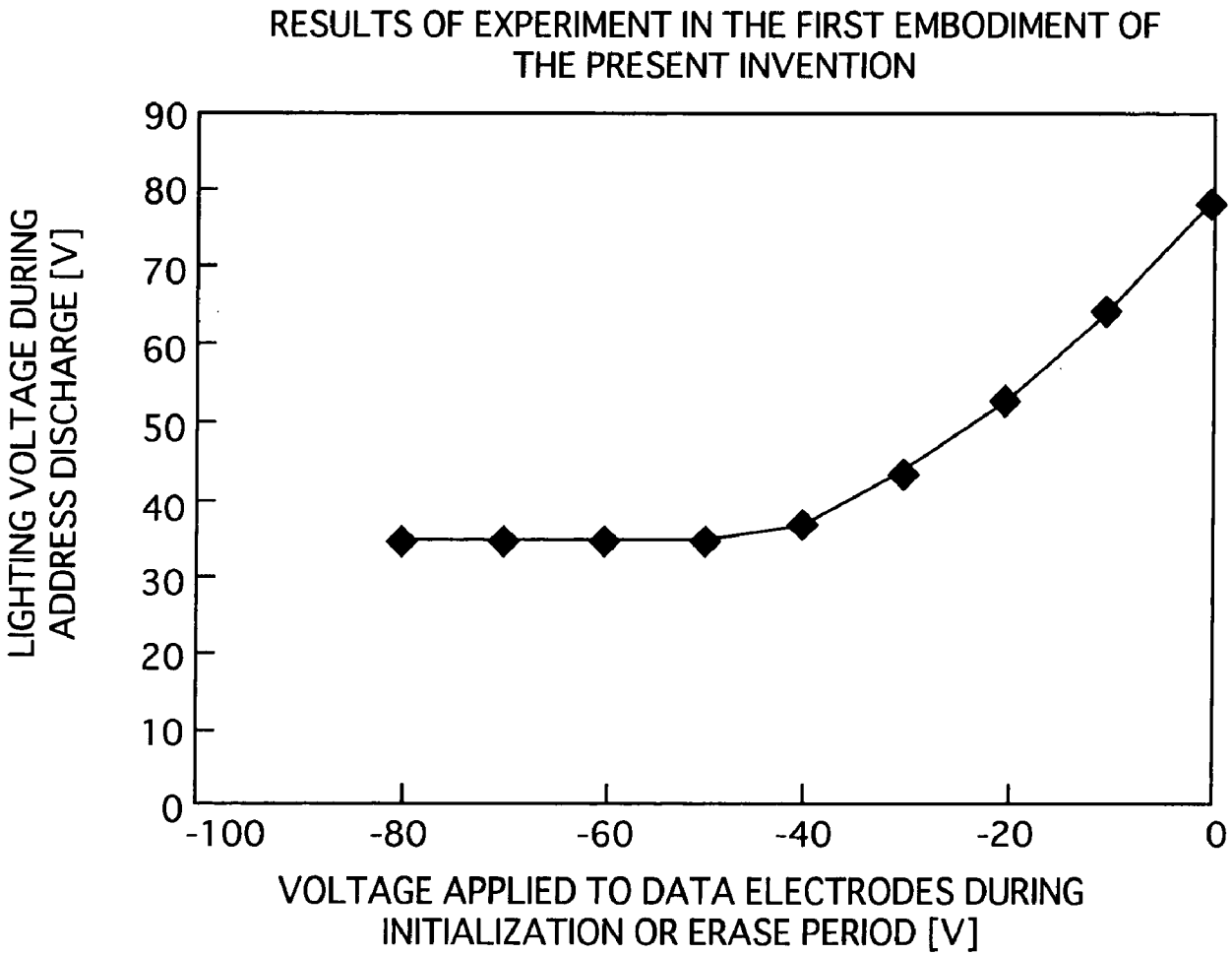
FIG. 5 is a graph illustrating a relation between a voltage applied to data electrodes and a lighting voltage during sustain discharge.

It is preferable that a range of a peak value of the negative polarity pulse that is applied to the data electrodes 32 while the gradually decreasing voltage is applied to the scanning electrodes 25 during the initialization period is between −80 V and 0 V inclusive, because a lighting voltage can be made smaller, as shown in a graph in FIG. 5 illustrating a relation between the voltage applied to the data electrodes during the down ramp of the initializing or erase period and the address voltage for lighting all of the cells (a data electrodes pulse during the write period in which it is possible to light during the sustain period). In terms of actual driving, it is desirable that the range of the peak value of the pulse applied to the data electrodes 32 is between −50 V and −1 V inclusive.

With the above described advantageous technical measures, it is possible, during the initialization period in the subfields of the First Embodiment, in order to prepare the successive write period, to suppress the variation of the write pulse among all of the discharge cells corresponding to the red, green, and blue phosphor layers 35, 36, and 37, and to perform a desirable write discharge with less external power supply (and with a relatively low write pulse) in comparison with the conventional PDPs.

1-3-2 Write Period

During the write period after the initialization period, the PDP driving unit 40 applies a base voltage with a negative polarity (Vc) to the scanning electrodes 25 using the scanning driver 401. The positive polarity pulse (Ve) is applied to the sustaining electrodes 24 using the sustain driver 402 continuously from the initialization period.

Next, on a plain part of the PDP unit 10, the scanning pulse (Vb) to a first row of the scanning electrodes 25 from top and the write pulse (Vdat) to the data electrodes 32 corresponding to the discharge cells to light are applied at the same time, and the write discharge between the data electrodes 32 and the scanning electrode 25 is performed to form a sufficient amount of the wall charge on a surface of the dielectric layer 22. In the First Embodiment, because the wall charge has already been formed in the discharge cells during the initialization period, it is possible to start the write discharge without making the scanning pulse (Vb) and the write pulse (Vdat) very high. The same effect can be obtained in all of the discharge cells in which the data electrodes 32 are applied with the negative polarity pulse during the initialization period.

Then, in the same manner as described in the above, the write discharge between a second row of the scanning electrodes 25 (X electrodes 25) from top and the data electrodes 32 corresponding thereto is performed to form the wall charge on the surface of the dielectric layer 22.

As has explained in the above, the PDP driving unit 40 applies the scan pulse and the write pulse continuously, and sequentially forms the wall charge that is sufficient for the write discharge on the surface of the dielectric layer 22, and thus write a latent image for one screen.

1-3-3 Sustain Period

During the sustain period, the sustain voltage (Vs) is alternately applied to the scanning electrodes 25 and the sustaining electrodes 24 in turn, and thus performs the sustain discharge. Although the timing chart of driving waveform in FIG. 2 illustrates an example in which the sustain voltage is first applied to the scanning electrodes 25 and the period ends with the voltage application to the scanning electrodes 25, it is also possible that the sustain voltage is first applied to the sustaining electrodes 24. An example of the present invention that the sustain discharge starts from applying a voltage first either to the scanning electrodes 25 or to the sustaining electrodes 24 and ends with applying the voltage to the sustaining electrodes 24 will be explained in a Second Embodiment.

1-3-4 Erase Period

Just before the sustain period ends, the PDP driving unit 40 applies a pulse with a small width to the scanning electrodes 25 through the scanning driver 401. Then, during the erase period, a potential of the scanning electrodes 25 is reduced from Vd to Vb by applying the gradually decreasing voltage.

Further, in accordance with a timing in which the scanning electrodes 25 is applied with the gradually decreasing voltage, the negative polarity pulse Vset (Vset(B)) is applied to the data electrodes 32, in the same manner as in the initialization period. By doing so, the same effect as in the initialization period can be obtained in the erase period.

The PDP driving unit 40 displays a screen in the PDP unit 10 by repeating operations explained from 1-3-1 through 1-3-4.

Some of the subfields include either the initialization period or the erase period. Further, some subfields do not include either the initialization period or the erase period. The First Embodiment, the Second Embodiment, and variations of these embodiments are applied to cases of the subfields including at least one of the initialization period and the erase period.

1-4 Variations of First Embodiment

In the above First Embodiment, an example is shown about a case in which the negative polarity pulse having the predetermined peak values is applied to the data electrodes 32 during the initialization period and the erase period according to the variation of the write pulse to the data electrodes 32 among the red, green, and blue phosphor layers 35, 36, and 37.

However, the present invention is not restricted to the above example, and it is also possible to apply the negative polarity pulse based on the variation in discharge ratios (lighting efficiency) of the data electrodes 32.

In other words, reasons other than the above described chemical property of the phosphor material can also cause write defects during the write period in the plasma display devices.

A proportion that the discharge is caused can be expressed as a discharge ratio of the plasma display device, and the discharge ratio is determined by a relation among a time period before the discharge is performed (tf), a statistical time lag of the discharge (ts), and the voltage pulse width.

A probability N(tpw)/N0 of the discharge occurrence to the pulse width tpw, is derived by an equation (1) below, for example ("The Institute of Television Engineers of Japan Technical Report", vol.19, No.66, pp55–66 (1955)).

$$N(tpw)/N0=1-\exp(-(tpw-tf)/ts) \quad (1)$$

The discharge ratio expressed by the equation (1) indicates that tf and ts are required to be small to make the discharge easy to occur.

In this variation of the First Embodiment, measurement of tf and ts was carried out under conditions below.

Specifically, using the voltages set for the VGA standard panel as described above, the cells of a single color light in a diagonal pattern only during a seventh subfield in one field. In the above status, an abalance photo diode (APD) was subjected to light by the write discharge, and then, the light emission was measured by an oscilloscope for 300–500 times after converting the voltage. The measured values were sorted in an order according to the discharge time lag, and a earliest discharge time lag during a period from a point when the write pulse was applied before the data electrodes 32 till the discharge light emission was observed was taken as a forming time (tf).

Further, a ratio 1−N(tpw)/N0, which was proportion that the discharge did not occur before a time t, was measured, and the statistical time lag of the discharge (ts) was derived from a slope −1/ts when single logarithm to t was plotted. Here, the discharge ratio was derived by taking an address pulse of 1.9 μs in width, as one example.

By the discharge ratio derived in the above manner, it is possible to distinguish the data electrodes 32 whose discharge ratio is higher than a given ratio from the data electrodes 32 whose discharge ratio is lower than the given ratio. In addition, another experiment has already made it clear that it is desirable to make an absolute value of a negative polarity voltage to be applied larger when the discharge ratio of the data electrodes 32 is lower.

For example, as a result of calculation, it was found out that, when there were some data electrodes having a discharge ratio of 95% and above and other data electrodes having a discharge ratio in a range of 63% inclusive to 95% exclusive, it is desirable to apply a negative polarity pulse having a peak value in a range of −50 V inclusive to 0 V exclusive to the data electrodes having the discharge ratio between 63% inclusive and 95% exclusive.

In the same way, it was also found out that it is desirable to apply a negative polarity pulse having a peak value in a range of −60 V inclusive to −5 V inclusive to the data electrodes having a discharge ratio between 40% inclusive and 63% exclusive, and a negative polarity pulse having a peak value in a rang between −80 V inclusive and −10 V inclusive to the data electrodes having a discharge ratio lower than 40%.

When all of the data electrodes 32 in one plasma display device have a discharge ratio higher than any of the above three discharge range, the data driver IC may be connected to high voltage direct-current power sources that are suitable to obtain appropriate Vset for each of the data electrodes 32, and set so as to the data electrodes 32 can be controlled by the main control circuit in the same way as the conventional method.

One of reasons why the discharge ratio varies according to parts of the PDP unit 10 is the variation in the film thickness of the dielectric layer 22. Specifically, due to manufacturing reasons, both side parts of the dielectric layer 22 in an x direction of the PDP unit 10 easily become thicker than the other part of the dielectric layer 22. Accordingly, the discharge start voltage at the both side parts of the PDP unit 10 in a widthwise direction becomes relatively high, and the discharge ratio of the side parts becomes low.

Further, thickness of the protecting layer can affect the discharge ratio. Specifically, when the protecting layer (MgO) is formed by energy beam evaporation, if the evaporation is performed while a panel is carried along a y direction of the PDP unit 10, the film thickness varies and the plane direction in crystal structure become relatively random along lines that are in parallel with the x direction of the panel, although the protecting layer has a relatively uniform film thickness and plane direction in crystal structure along lines that are in parallel with the y direction of the panel. Such a tendency becomes noticeable in a vicinity of a center of the PDP unit 10, and also is a reason to cause the decrease in the discharge ratio.

It is possible to obtain substantially the same effect as the First Embodiment by taking the variation in the discharge ratio into consideration, evaluating a negative polarity pulse having a desirable peak value for any given data electrodes 32, and applying the negative polarity pulse to the data electrodes 32.

1-5 Miscellaneous

In the above First Embodiment, an example in which the negative polarity pulse is applied to all of the data electrodes 32 that correspond to red, green, and blue phosphor layers 35, 36, and 37 during the initialization period and the erase period is explained. However, the present invention is not restricted to the above example, and the negative polarity pulse may be applied only to the data electrodes 32 that correspond to any of red, green, and blue phosphor layers 35, 36, and 37 (only to the data electrodes 32 corresponding to the blue phosphor layer 37, for example). The same can be applied to the Second Embodiment explained below and variations thereof.

[Second Embodiment]

2-1 Plasma Display Device According to Second Embodiment

The Second Embodiment has substantially the same device structure as the First Embodiment, and therefore an explanation about the structure is not given here. A characteristic of the Second Embodiment is in a driving waveform process (sequence).

Specifically, in the Second Embodiment, the sustain period in one subfield ends with a voltage applied to the sustaining electrodes 24, and a positive polarity pulse is applied to the data electrodes 32 while a gradually increasing voltage is applied to the scanning electrodes 25 during either the initialization period or the erase period successive to the sustain period.

2-2 Process for Driving Plasma Display Device

A driving process of the plasma display panel according to the Second Embodiment is explained below in accordance with a timing chart of driving waveform in a (m−1)-th subfield illustrated in FIG. 6.

Note that a final pulse in the sustain period of a (m−2)-th subfield is applied to the sustaining electrodes 24.

Further, in a case in which the PDP unit 10 is a VGA standard panel (853×480 pixels), specific values in a driving waveform can be substantially the same as the First Embodiment, as shown below.

Va=400 v (a maximum value in the initialization period of the scanning electrodes 25)

Vb=−100 v (a minimum value in the initialization period of the scanning electrodes 25, and the write pulse to the scanning electrodes 25)

Vc=−20 v (a base value of the scanning electrodes 25 in the write period)

Vd=140 v (a base value of the scanning electrodes 25 in the erase period)

Ve=150 v (a voltage value applied to the sustaining electrodes 24 in the initialization period and the write period)

Vs=180 v (a voltage applied to the scanning electrodes 25 and the sustaining electrodes 24 in the sustain period)

Vdat=67 v (the write pulse to the data electrodes 32)

Vset=20 v (a voltage value applied to the data electrodes 32, which correspond to the red and green phosphor layers, in the initialization period)

Vset(B)=60 v (a voltage value applied to the data electrodes 32, which correspond to the blue phosphor layer, in the initialization period)

In a case of the above example of the XGA standard panel, a pitch between the barrier ribs 34 is 300 μm, a thickness of the dielectric layer 22 is 35 μm, a thickness of the protecting layer 23 is 0.8 μm, a gap between a pair of display electrodes 24 and 25 is 80 μm, and a height of the barrier ribs 34 is 120 μm.

Further, in a case in which the PDP unit 10 is a XGA standard panel (1024×768 pixels), specific values can be substantially the same as the First Embodiment, as shown below.

Va=400 v (a maximum value in the initialization period of the scanning electrodes 25)

Vb=−90 v (a minimum value in the initialization period of the scanning electrodes 25, and the write pulse to the scanning electrodes 25)

Vc=−10 v (a base value of the scanning electrodes 25 in the write period)

Vd=140 v (a base value of the scanning electrodes 25 in the erase period)

Ve=150 v (a voltage value applied to the sustaining electrodes 24 in the initialization period and the write period)

Vs=160 v (a voltage applied to the scanning electrodes 25 and the sustaining electrodes 24 in the sustain period)

Vdat=67 v (the write pulse value to the data electrodes 32)

Vset=20 v (a voltage value applied to the data electrodes 32, which correspond to the red and green phosphor layers, in the initialization period)

Vset(B)=60 v (a voltage value applied to the data electrodes 32, which correspond to the blue phosphor layer, in the initialization period)

In a case of the above example of the XGA standard panel, a pitch between the barrier ribs 34 is 300 μm, a thickness of the dielectric layer 22 is 35 μm, a thickness of the protecting layer 23 is 0.8 μm, a gap between a pair of display electrodes 24 and 25 is 80 μm, and a height of the barrier ribs 34 is 120 μm.

2-3-1 Initialization Period

During the initialization period, the scanning driver 401 of the PDP driving unit 40 applies a positive polarity initializing pulse to each scanning electrode 25 (X electrode 25) to initialize charges (wall charge) in each of the cells.

Figure 6:
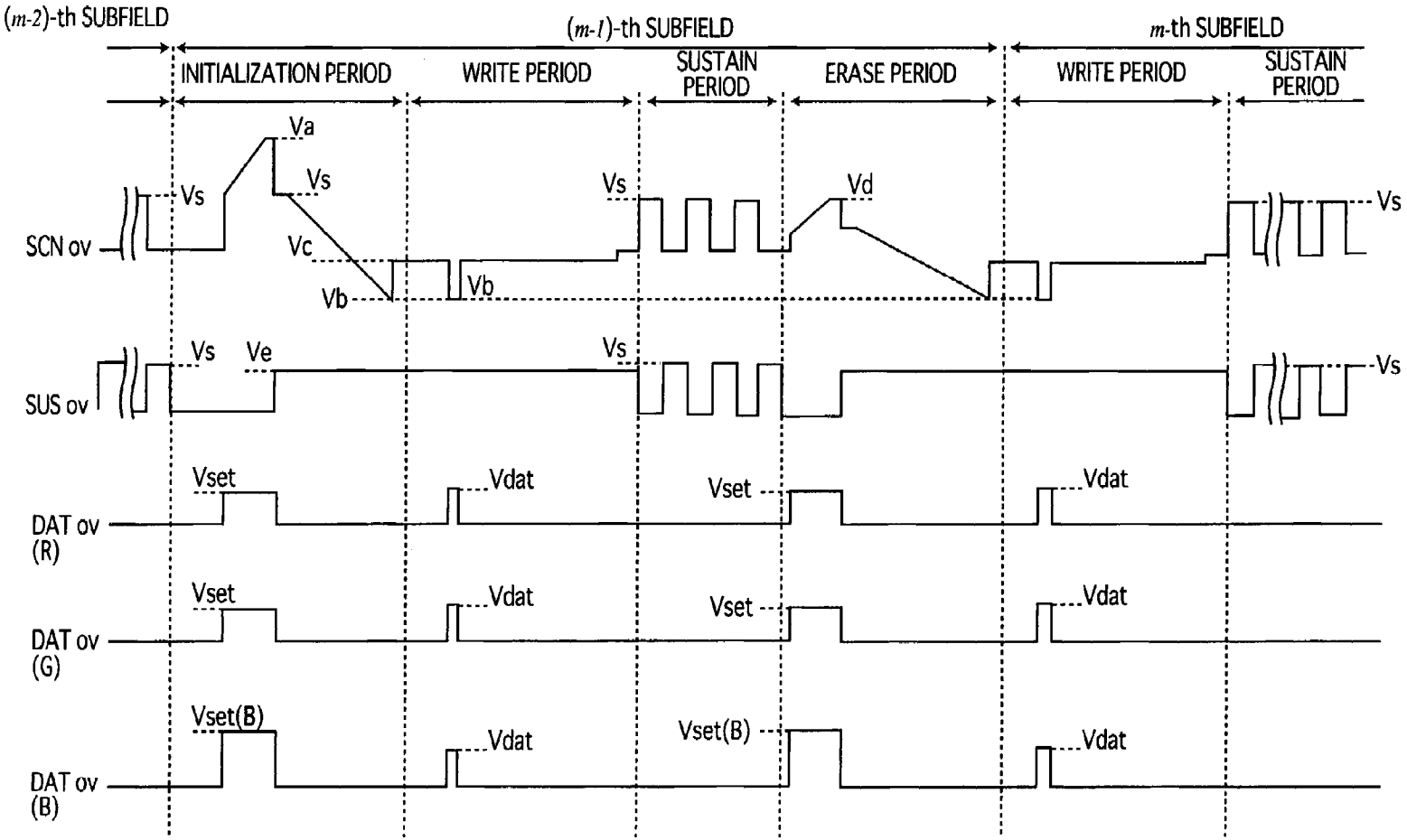
FIG. 6 is a timing chart of a driving wave form according to a Second Embodiment.

A waveform of the initializing pulse applied to the scanning electrodes 25 is shown in FIG. 6; it increases gradually at first, and then decreases gradually. At the same time when the voltage applied to the scanning electrodes 25 reaches the maximum value (Va), a rectangular positive polarity pulse (Ve) is applied to the sustaining electrodes 24.

Here, as a main characteristic of the Second Embodiment, a positive polarity voltage (Vset) is applied to the data electrodes 32 while the gradually increasing voltage is applied to the scanning electrodes 25. Further, when the final pulse in the sustain period is applied to the scanning electrodes 25 in a subfield, the positive polarity pulse is also applied to the data electrodes 32 while the gradually increasing voltage is applied in the erase period which is successive to the sustain period. When both the initialization period and the erase period are included in one subfield, it is desirable to apply the positive polarity pulse in the both period, although the positive polarity pulse may be applied only during one of the both period.

A reason why the positive polarity pulse is applied to the data electrodes 32 is explained below.

Figure 7:
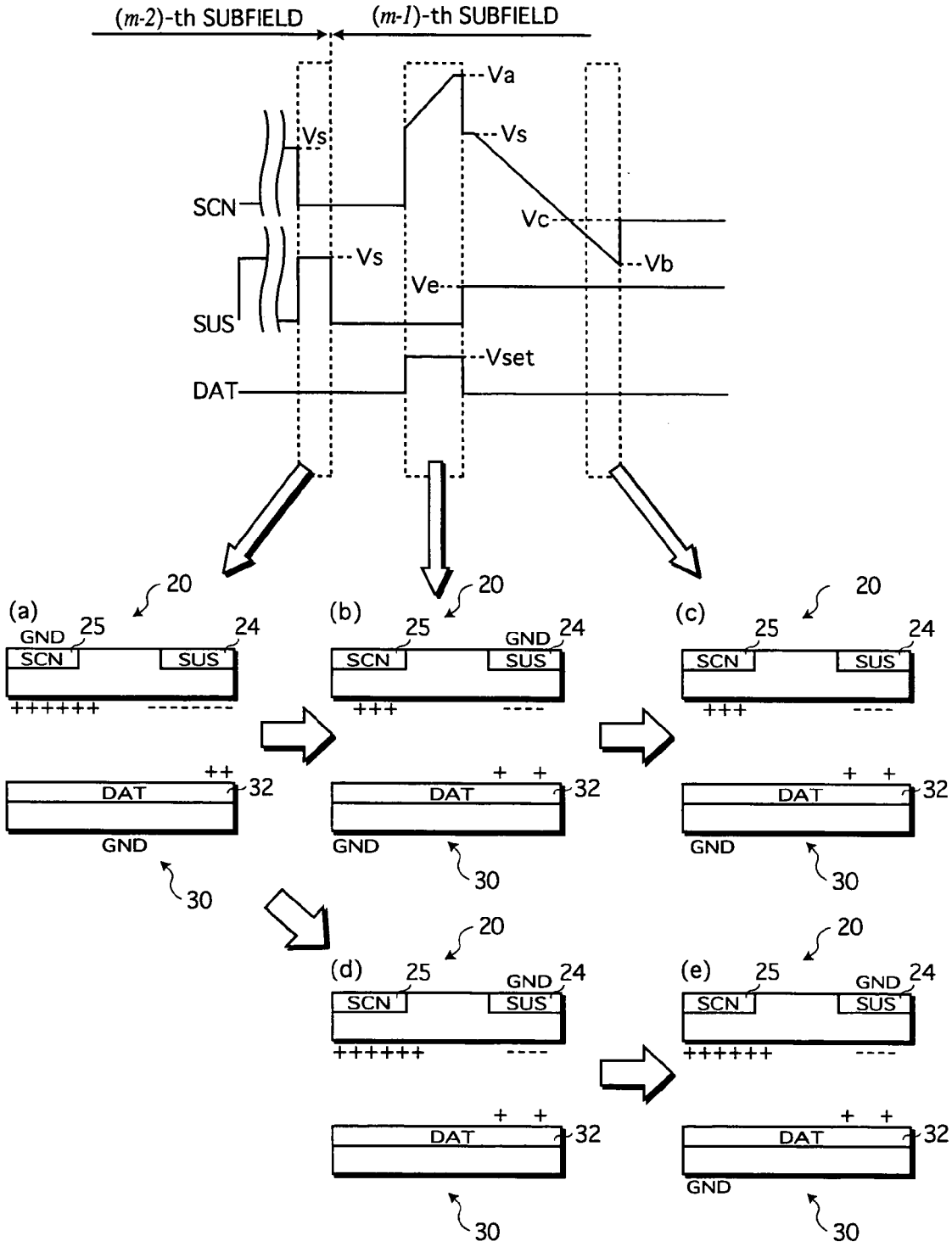
FIG. 7 is a state diagram illustrating a state of electrical charge of a PDP unit in subfields in the Second Embodiment.

FIG. 7 is a timing chart of driving waveform during the sustain period in a (m−2)-th subfield and the initialization period in the (m−1)-th subfield that is successive to the (m−2)-th subfield in FIG. 6. Also in FIG. 7, "(a)→(b)→(c)" indicates a shift in a state of electrical charge of the conventional PDP, and "(a)→(d)→(e)" indicates a shift in a state of electrical charge of the PDP unit 10 according to the Second Embodiment.

Conventionally, when the sustain period in the (m−2)-th subfield ends with a pulse applied to the sustaining electrodes 24, a relatively large amount of wall charge is left at the scanning electrodes and the sustaining electrodes 24 as shown in FIG. 7(*a*). Then, when the scanning electrodes 25 are applied with a gradually increasing voltage (up ramp) during the initialization period in the (m−1)-th subfield, a negative charge is formed on the scanning electrodes 25 as shown in FIG. 7(*b*), and an amount of charge formed on each of the sustaining electrodes 24 and data electrodes 32 decreases by the dielectric effect caused at the same time. The wall charge of the PDP unit 10 as a whole also decreases. The wall charge remains at a reduced amount through the scanning electrodes 25 are applied with a gradually decreasing voltage (down ramp), as shown in FIG. 7(*c*). Accordingly, the power supply for the scan pulse (Vb) applied to the scanning electrodes 25 and the write pulse (Vdat) applied to the data electrodes 32 during the write period successive to the initialization period is largely dependent upon an external power source.

In view of the above problem, in the Second Embodiment, the positive polarity pulse is applied to the data electrodes 32 while the gradually increasing voltage is applied to the scanning electrodes 25 during the initialization period. The wall charge formed in the conventional PDP as shown in FIG. 3(*a*) (an application of the voltage to the sustain electrodes 24) decreases as shown FIG. 7(*c*). However, according to the Second Embodiment, the potential of the scan electrodes 25 to the data electrodes 32 is maintained relatively small, and accordingly the wall charge is also maintained. Therefore, the amount of the wall charge is kept relatively large even at a point (e) in FIG. 7, where the end of the initialization period is very close. Thus, in the Second Embodiment, it is possible to obtain the same effect as the First Embodiment that an actual power supply from the external power source (refer to the high voltage direct-current power source in FIG. 1) is reduced when applying the write pulse to the data electrodes 32 in the write period successive to the initialization period. In other words, an amount of necessary power supply to the data electrodes 32 in order to perform the write discharge is not very large, and accordingly, it is possible to demonstrate an excellent display performance at a low cost without using a high pressure resistant data driver IC, even in a case of a plasma display device such as a hi-vision display with a fine cell structure.

In addition, also in the Second Embodiment like in the First Embodiment, it is also possible, while the gradually increasing voltage is applied during the initialization period, to apply to the data electrodes 32 corresponding to the blue phosphor layer 37 with a pulse (Vset (B)) whose absolute value is larger than an absolute value of a negative polarity pulse applied to the data electrodes the red and green phosphor layers 35 and 36. By doing so, it is possible that the data electrodes 32 corresponding to the blue phosphor layer 37 selectively hold a large amount of wall charge, and that the write discharge is performed in the discharge cells corresponding to the phosphor layer 37 of blue with a relatively small amount of external power supply.

It is preferable that a range of a peak value of the positive polarity pulse that is applied to the data electrodes 32 while the gradually increasing voltage is applied to the scanning electrodes 25 during the initialization period is between 0 V and 80 V inclusive, because the result of the experiment shows that a lighting voltage can be made smaller. In terms of actual driving, it is desirable that the range of the peak value of the voltage applied to the data electrodes 32 is between 0 V and 50 V inclusive.

With the above described advantageous technical measures, it is possible, during the initialization period in the subfields of the Second Embodiment, in order to prepare the successive write period, to suppress the variation of the write pulse among all of the discharge cells corresponding to the red, green, and blue phosphor layers 35, 36, and 37, and to perform a desirable write discharge with a relatively small amount of external power supply (and with a relatively low write pulse).

2-3-2 Write Period

During the write period after the initialization period, the PDP driving unit 40 applies a base voltage with a negative polarity (Vc) to the scanning electrodes 25 using the scanning driver 401. The positive polarity pulse (Ve) is applied to the sustaining electrodes 24 using the sustain driver 402 continuously from the initialization period.

Next, on a plain part of the PDP unit 10, the scanning pulse (Vb) to a first row of the scanning electrodes 25 from top and the write pulse (Vdat) to the data electrodes 32 corresponding to the discharge cells to light are applied at the same time, and the write discharge between the data electrodes 32 and the scanning electrode 25 is performed to form a sufficient amount of the wall charge on a surface of the dielectric layer 22. In the Second Embodiment, because the wall charge has already been formed in the discharge cells during the initialization period, it is possible to start the write discharge without making the power supply from the external power source for scanning pulse (Vb) and the write pulse (Vdat) very high.

Then, in the same manner as described in the above, the write discharge between a second row of the scanning electrodes 25 (X electrodes 25) from top and the data electrodes 32 corresponding thereto is performed to form the wall charge on the surface of the dielectric layer 22.

As has explained in the above, using the successive scan pulse, the PDP driving unit 40 sequentially forms the wall charge, which corresponds to the discharge cells for displaying a screen by the write discharge, on the surface of the dielectric layer 22, and thus write a latent image for one screen.

2-3-3 Sustain Period

During the sustain period, the sustain voltage (Vs) is alternately applied to the scanning electrodes 25 and the sustaining electrodes 24 in turn, and thus performs the sustain discharge. Although the driving waveform in FIG. 6 illustrates an example in which the sustain voltage is first applied to the scanning electrodes 25 and the period ends with the voltage application to the scanning electrodes 25 in the sustain period, it is also possible that the sustain voltage is first applied to the sustaining electrodes 24.

2-3-4 Erase Period

Just before the sustain period ends, the PDP driving unit 40 applies a pulse with a small width to the scanning electrodes 25 through the scanning driver 401. Then, during the erase period, the voltage of the scanning electrodes 25 is reduced from Vd to Vb by applying the gradually decreasing voltage.

Further, in accordance with a timing in which the scanning electrodes 25 is applied with the gradually decreasing voltage, the positive polarity pulse Vset (Vset(B)) is applied to the data electrodes 32, in the same manner as in the initialization period. By doing so, the same effect as in the initialization period can be obtained.

The PDP driving unit 40 displays a screen in the PDP unit 10 by repeating operations explained from 2-3-1 through 2-3-4.

Some of the subfields include either the initialization period or the erase period. Further, some subfields do not include either the initialization period or the erase period. The Second Embodiment is applied to cases of the subfields including at least one of the initialization period and the erase period.

3 Variations of Embodiments

Drive sequences explained in the above First and Second Embodiments were such that the final pulse in the sustain period is applied to either of the scanning electrodes 25 and the sustaining electrodes 24. However, it is also possible to apply the present invention to a case in which the final pulse in the sustain period is applied to the scanning electrodes 25 or to the sustaining electrodes 24 depending on subfields in a field.

Figure 8:
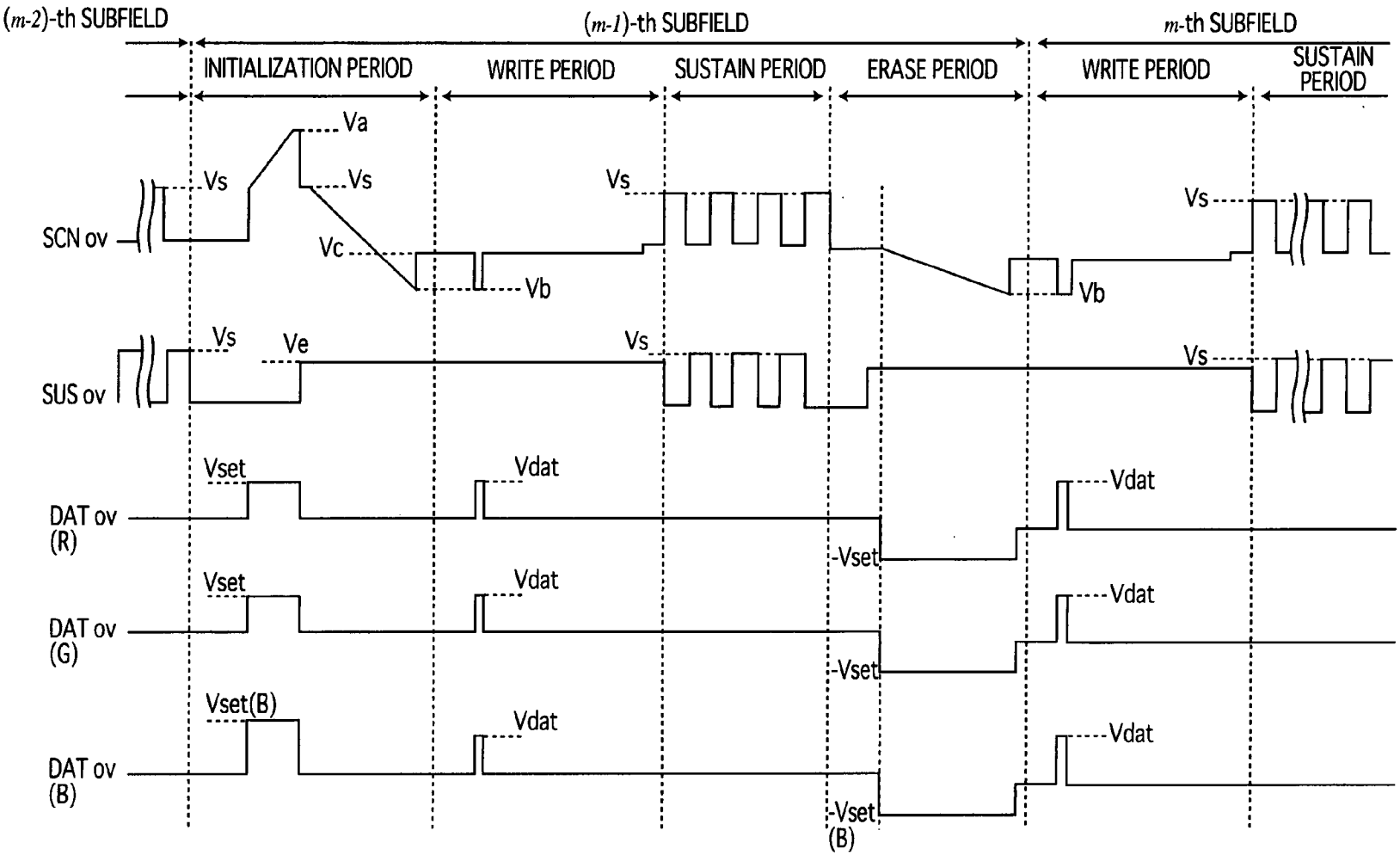
FIG. 8 is a timing chart of a driving wave form according to a variation of the Embodiments.
Figure 9:
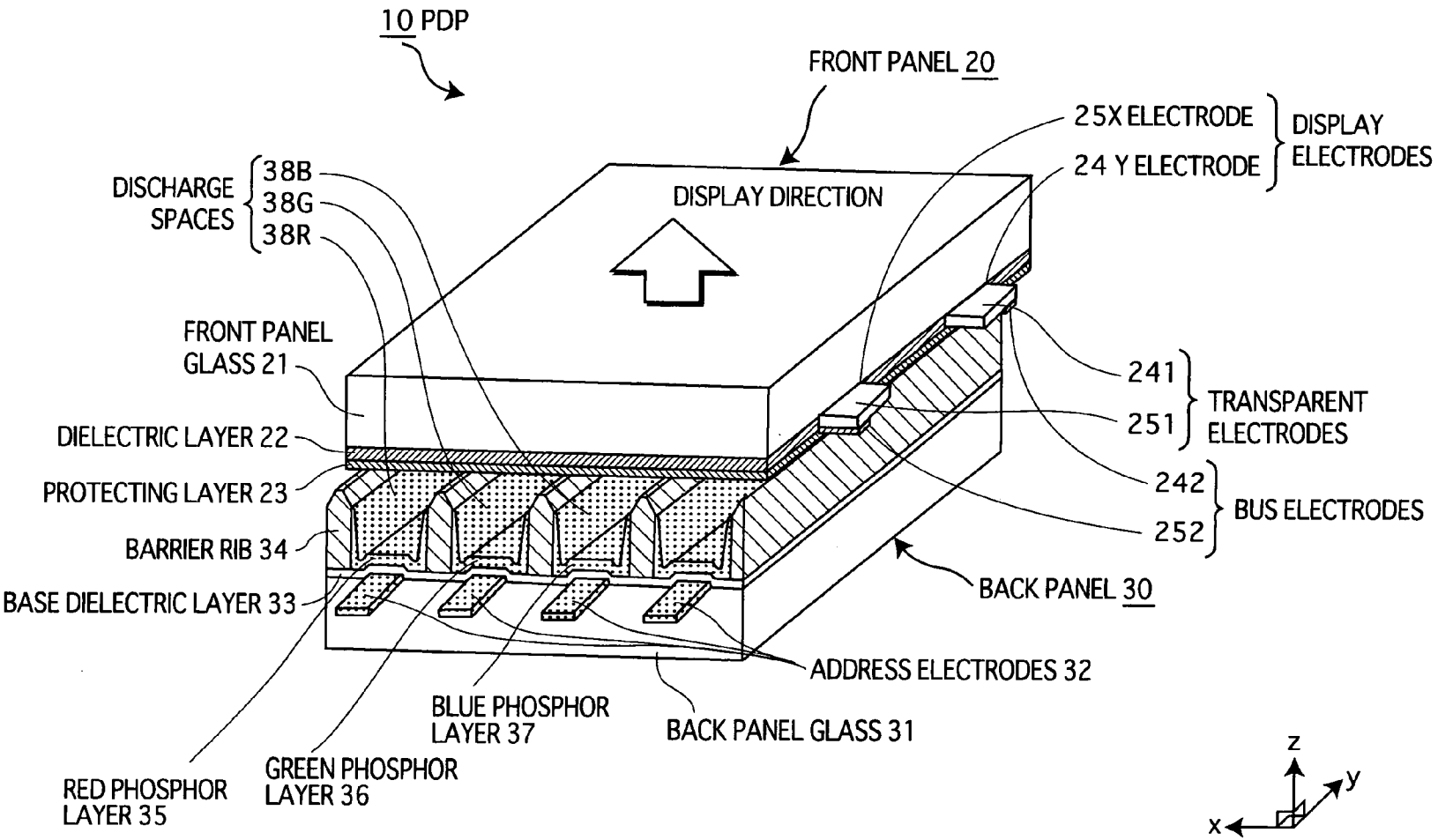
FIG. 9 is a perspective view illustrating an overall structure of an AC plasma display panel.
Figure 10:
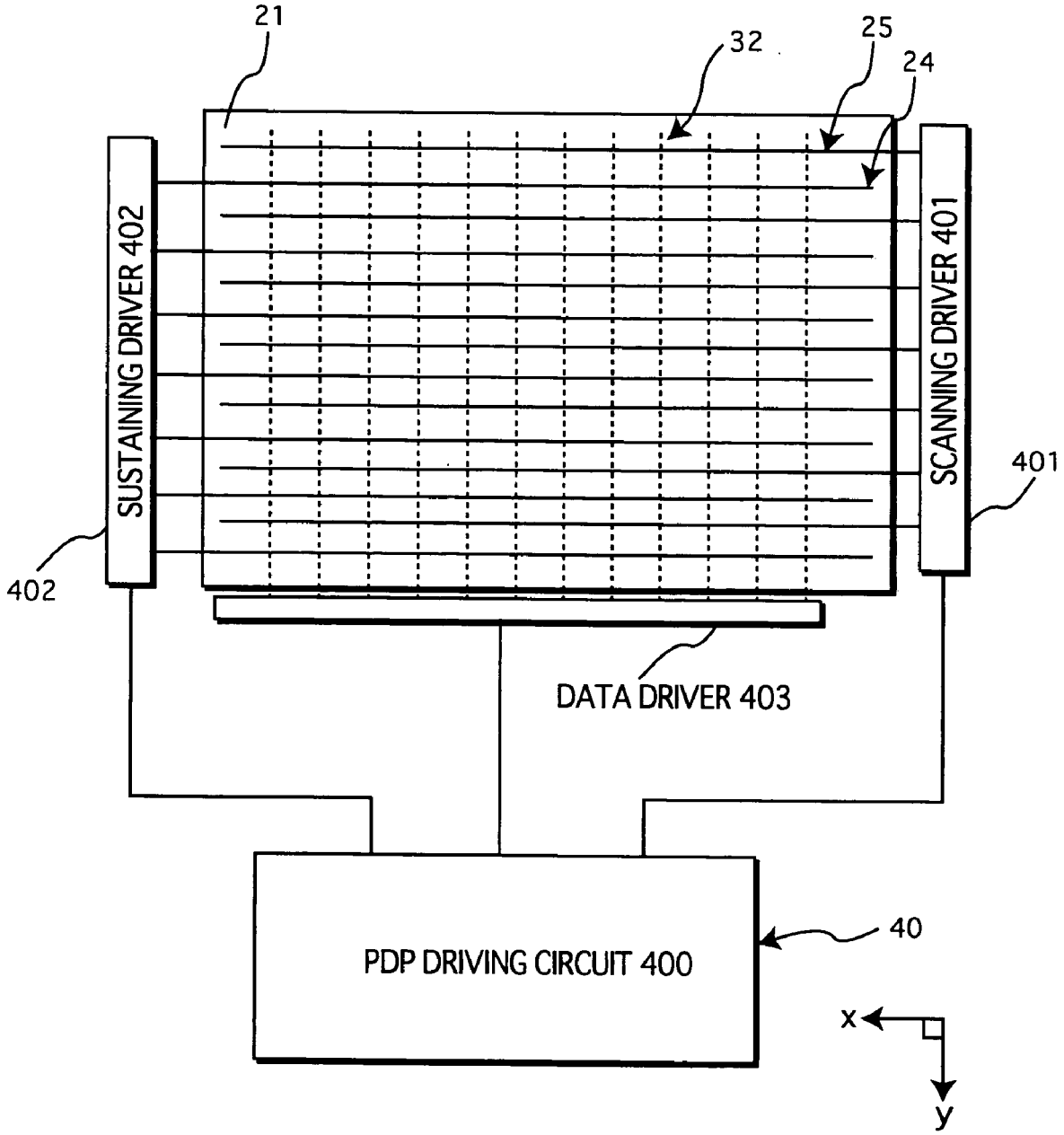
FIG. 10 is a schematic view of a PDP driving unit and display electrodes.
Figure 11:
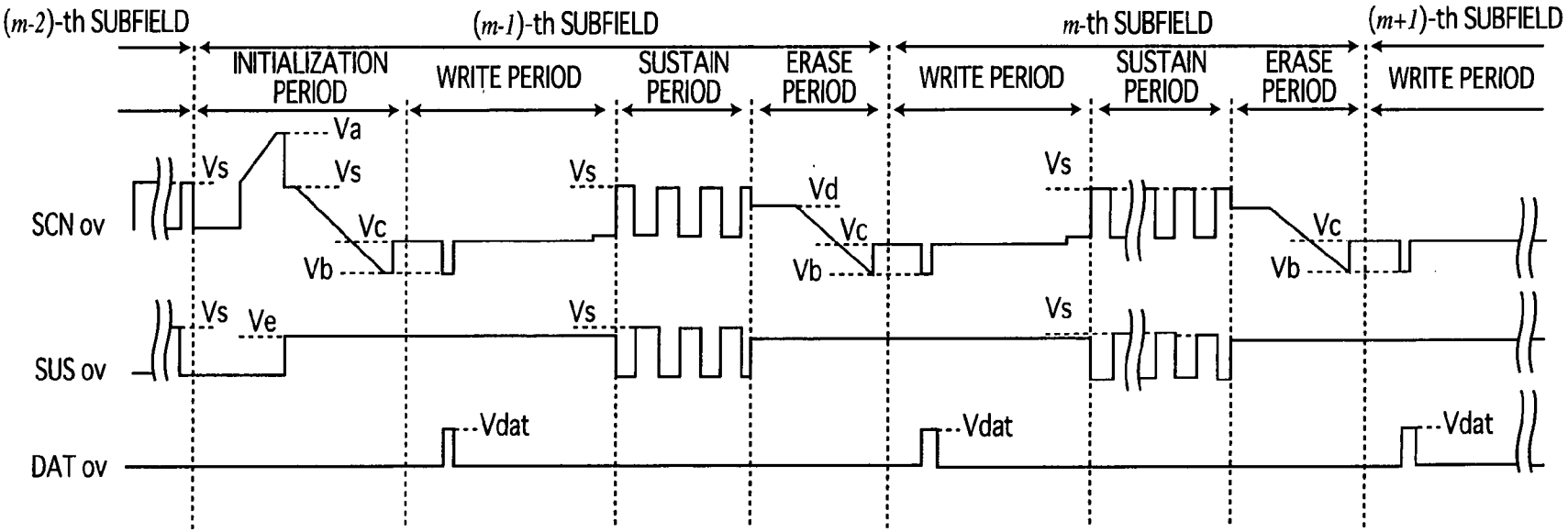
FIG. 11 is a timing chart of a driving waveform according to a conventional plasma display device.

FIG. 8 is a timing chart of driving waveform in which a final pulse in the sustain period of the (m−2)-th subfield is applied to the sustaining electrodes 24, and a final pulse in a next sustain period of the (m−1)-th subfield is applied to the scanning electrodes 25. In a case of the above driving waveform, the Second Embodiment is employed to the initialization period of the (m−1)-th subfield when the gradually increasing voltage is applied to the scanning electrodes 25 (i.e. the data electrodes 32 are applied with the positive polarity pulse), and it is possible to reduce an amount of power supply necessary for Vb and Vdat in the successive write period. Then, the First Embodiment is employed to the erase period of the (m−1)-th subfield when the gradually decreasing voltage is applied to the scanning electrodes 25 (i.e. the data electrodes 32 are applied with the negative polarity pulse), and the amount of power supply necessary for Vb and Vdat in the successive write period is reduced. As has been explained in the above, the present invention has a characteristic that it is possible to obtain a high effect by changing the polarity of the voltage to be applied to the data electrodes 32 depending on whether the final pulse in a given sustain period just before either an erase period or an initialization period is applied to the scanning electrodes 25 or the sustaining electrodes 24.

4 Miscellaneous

Any of the above First and Second Embodiments and the variations of the embodiments is not restricted to the example in which the data electrodes are divided into groups according to types of the phosphor layers. As shown in the variation of the First Embodiment, it is possible to divide the data electrodes into groups according to the discharge ratio of the discharge cells.

Further, in the above First and Second Embodiments, the data driver is connected to the two data electrode groups, one of which corresponding to the red and green phosphor layers, and the other corresponding to the blue phosphor layer, so as to supply power to each of the electrode group through a separate power connection. However, the present invention is not restricted to the above embodiments, and it is possible to use more than one data driver. For example, it is also possible that the data electrode groups corresponding to each of the phosphor layers of red, green, and blue are each connected to a separate data driver.

Industrial Applicability

The present invention can be applied to television sets, especially to hi-vision television sets operable to display images in a high resolution.

The invention claimed is:

1. A method of driving a plasma display device in which a plurality of scanning electrodes and a plurality of sustaining electrodes are formed on a first substrate of a plasma display panel, and a plurality of data electrodes are formed on a second substrate of the plasma display panel, the first substrate and the second substrate being positioned so as to face each other, wherein if a rectangular pulse as a final pulse included in a sustain period of an (m−2)-th subfield among a plurality of subfields belonging to one field is applied to the scanning electrodes and an initialization period is included in an (m−1)-th subfield the data electrodes are applied with a negative polarity pulse at the same time when a voltage applied to the scanning electrodes gradually decreases during the initialization period, if the rectangular pulse as a final pulse included in the sustain period of the (m−2)-th subfield is applied to the sustaining electrodes and the initialization period is included in the (m−1)-th subfield, the data electrodes are applied with a positive polarity pulse at the same time when a voltage applied to the scanning electrodes gradually increases during the initialization period, and m is any given integer.

2. A method of driving a plasma display device according to claim 1, wherein a plurality of barrier ribs are disposed on the second substrate in a direction along the data electrodes, each pair of adjacent barrier ribs having a phosphor layer disposed therebetween along one of the data electrodes, each phosphor layer being one of red, green, and blue, and a peak value of one of the negative polarity pulse and the positive polarity pulse is applied to the data electrodes each corresponding to the phosphor layer of a color having a lowest lighting efficiency.

3. A method of driving a plasma display device according to claim 2, wherein the color having the lowest lighting efficiency is blue.

4. A method of driving a plasma display device according to claim 1, wherein a peak value of one of the negative polarity pulse and the positive polarity pulse is determined according to a discharge ratio of any given data electrode.

5. A method of driving a plasma display device according to claim 4, wherein when the discharge ratio is in a range of 63% inclusive to 95% exclusive, the peak value of the negative polarity pulse is set in a range of −50 V inclusive to 0 V exclusive, when the discharge ratio is in a range of 40% inclusive to 63% exclusive, the peak value of the negative polarity pulse is set in a range of −60 V inclusive to −5 V inclusive, and when the discharge ratio is lower than 40%, the peak value of the negative polarity pulse is set in a range of −80 V inclusive to −10 V inclusive.

6. A method of driving a plasma display device according to claim 1, wherein a peak value of the negative polarity pulse is in a range of −80 V inclusive to −1 V inclusive, and the peak value of the positive pulse is in a range of 1 V inclusive to 80 V inclusive.

7. A method of driving a plasma display device in which a plurality of scanning electrodes end a plurality of sustaining electrodes are formed on a first substrate of a plasma display panel, and a plurality of data electrodes are formed on a second substrate of the plasma display panel, the first substrate and the second substrate being positioned so as to face each other, wherein if a rectangular pulse as a final pulse included in a sustain period of at least one subfield of a plurality of subfields belonging to one field is applied to the scanning electrodes and the sustain period is followed by en erase period, the data electrodes are applied with a negative polarity pulse at the same time when a voltage applied to the scanning electrodes gradually decreases during the initialization period, if the rectangular pulse as the final pulse included in the sustain period is applied to the sustaining electrodes and the sustain period is followed by the erase period, the data electrodes are applied with a positive polarity pulse at the same time when a voltage applied to the sustaining electrodes gradually decreases during the initialization period.

8. A method of driving a plasma display device according to claim 7, wherein a plurality of barrier ribs are disposed on the second substrate in a direction along the data electrodes, each pair of adjacent barrier ribs having a phosphor layer disposed therebetween along one of the data electrodes, each phosphor layer being one of red, green, and blue, and a peak value of one of the negative polarity pulse and the positive polarity pulse is applied to the data electrodes each corresponding to the phosphor layer of a color having a lowest lighting efficiency.

9. A method of driving a plasma display device according to claim 8, wherein the color having the lowest lighting efficiency is blue.

10. A method of driving a plasma display device according to claim 7, wherein a peak value of one of the negative polarity pulse and the positive polarity pulse is determined according to a discharge ratio of any given data electrode.

11. A method of driving a plasma display device according to claim 10, wherein when the discharge ratio is in a range of 63% inclusive to 95% exclusive, the peak value of the negative polarity pulse is set in a range of −50 V inclusive to 0 V exclusive, when the discharge ratio is in a range of 40% inclusive to 63% exclusive, to peak value of the negative polarity pulse is set in a range of −60 V inclusive to −5 V inclusive, and when the discharge ratio is lower than 40%, the peak value of the negative polarity pulse is set in a range of −80 V inclusive to −10 V inclusive.

12. A method of driving a plasma display device according to claim 7, wherein a peak value of the negative polarity pulse is in a range of −80 V inclusive to −1 V inclusive, and the peak value of the positive pulse is in a range of 1 V inclusive to 80 V inclusive.

13. A method of driving a plasma display device according to claim 7, wherein a peak value of the negative polarity pulse is in a range of −80 V inclusive to −1 V inclusive, and the peak value of the positive pulse is in a range of 1 V inclusive to 80 V inclusive.

14. A plasma display device comprising:

(a) a plasma display panel in which a plurality of pain of display electrodes, each pair including a scanning electrode and sustaining electrode, are formed on a first substrate, and a plurality of data electrodes and a plurality of barrier ribs are formed on a second substrate, the first substrate and the second substrate being positioned so as to face each other in a manner that the display electrodes and the data electrodes cross, and each pair of adjacent barrier ribs having a phosphor layer disposed therebetween along one of the data electrodes, each phosphor layer being one of red, green, and blue; and (b) a plasma display panel driving unit that applies voltages to the data electrodes and the pairs of display electrodes based on settings for a driving waveform process, wherein a pulse voltage that is applied to any given data electrode or to any given data electrode group is independent from a pulse voltage that is applied to data electrodes other than the given data electrode or the given data electrode group.

if a rectangular pulse as a final pulse included in a sustain period of an (m−2)-th subfield among a plurality of subfields belonging to one field is applied to the scanning electrodes and an initialization period is included in an (m−1)-th subfield, the data electrodes are applied with a negative polarity pulse at the same time when a voltage applied to the scanning electrodes gradually decreases during the initialization period, if the rectangular pulse an a final pulse included in the sustain period of the (m−2)-th subfield is applied to the sustaining electrodes and the initialization period is included in the (m−1)-th subfield, the data electrodes are applied with a positive polarity pulse at the same time when a voltage applied to the scanning electrodes gradually increases during the initialization period, and m is any given integer.

15. A plasma display device according to claim 14, wherein the pulse voltage is applied in at least one of an initialization period and an erase period of a subfield in a driving waveform process.

16. A plasma display device according to claim 14, wherein a pulse voltage that is applied to a first data electrode group, including data electrodes corresponding to the phosphor layers of red and green, is independent from a pulse voltage that is applied to a second data electrode group, including data electrodes corresponding to the phosphor layers of blue.

17. A plasma display device according to claim 14, wherein a pulse voltage that is applied to a first data electrode group, including data electrodes having a discharge ratio that is higher than a predetermined value, is independent from a pulse voltage that is applied to a second data electrode group, including data electrodes having a discharge ratio that is lower than the discharge ratio of the data electrodes included in the first data electrode group.

* * * * *

UNITED STATES PATENT AND TRADEMARK OFFICE

CERTIFICATE OF CORRECTION

PATENT NO. : 7,145,582 B2
APPLICATION NO. : 10/478289
DATED : December 5, 2006
INVENTOR(S) : Shindo et al.

It is certified that error appears in the above-identified patent and that said Letters Patent is hereby corrected as shown below:

In the Claims:
In Claim 1, Column 20, line 38, after "subfield" insert --,--.
In Claim 11, Column 22, line 6, "to" should be --the--.
In Claim 14, Column 22, line 25, "pain" should be --pairs--.
In Claim 14, Column 22, line 46, "." should be --,--.
In Claim 14, Column 22, line 55, "an" should be --as--.

Signed and Sealed this

Tenth Day of April, 2007

JON W. DUDAS
*Director of the United States Patent and Trademark Office*